US010518129B2

(12) United States Patent
Raiten et al.

(10) Patent No.: US 10,518,129 B2
(45) Date of Patent: Dec. 31, 2019

(54) STRETCHING MACHINE

(71) Applicants: Joshu Raiten, San Antonio, TX (US); Wayne Skloss, San Antonio, TX (US)

(72) Inventors: Joshu Raiten, San Antonio, TX (US); Wayne Skloss, San Antonio, TX (US)

(73) Assignee: THE BOARD OF REGENTS OF THE UNIVERSITY OF TEXAS SYSTEM, Austin, TX (US)

( * ) Notice: Subject to any disclaimer, the term of this patent is extended or adjusted under 35 U.S.C. 154(b) by 237 days.

(21) Appl. No.: 14/152,934

(22) Filed: Jan. 10, 2014

(65) Prior Publication Data

US 2014/0194266 A1 Jul. 10, 2014

Related U.S. Application Data

(60) Provisional application No. 61/750,893, filed on Jan. 10, 2013.

(51) Int. Cl.

| | |
|---|---|
| ***A63B 23/04*** | (2006.01) |
| ***A63B 21/00*** | (2006.01) |
| *A63B 23/00* | (2006.01) |

(52) U.S. Cl.

CPC ..... *A63B 23/0482* (2013.01); *A63B 21/4011* (2015.10); *A63B 21/4015* (2015.10); *A63B 21/4037* (2015.10); *A63B 2023/006* (2013.01); *A63B 2208/0252* (2013.01); *A63B 2225/09* (2013.01)

(58) Field of Classification Search

CPC ..... A63B 223/0482; A63B 23/0482; A63B 2023/006; A63B 21/4015; A63B 21/4037; A63B 21/4011; A63B 2208/052; A63B 2225/09

See application file for complete search history.

(56) References Cited

U.S. PATENT DOCUMENTS

| | | | | | |
|---|---|---|---|---|---|
| 1,904,039 | A * | 4/1933 | Bruder | A61H 7/001 | 482/142 |
| 3,596,654 | A * | 8/1971 | Tamura | A61H 1/02 | 601/25 |
| 4,474,370 | A * | 10/1984 | Oman | A63B 21/4029 | 482/104 |
| 4,621,809 | A * | 11/1986 | Pearl | A63B 21/4029 | 482/104 |
| 4,986,261 | A * | 1/1991 | Iams | A61H 1/0218 | 482/51 |
| 5,120,052 | A * | 6/1992 | Evans | A63B 23/0211 | 482/140 |
| 5,122,106 | A * | 6/1992 | Atwood | A61H 1/0244 | 482/131 |
| 5,277,681 | A * | 1/1994 | Holt | A61H 1/02 | 482/112 |
| 5,616,110 | A * | 4/1997 | Nascimento | | 482/131 |
| 7,014,602 | B2 * | 3/2006 | Yamauchi | A61H 1/0218 | 482/142 |
| 7,604,583 | B2 * | 10/2009 | Denisco | | 482/145 |
| 8,612,010 | B2 * | 12/2013 | Simmons | | 607/48 |

(Continued)

*Primary Examiner* — Megan Anderson

(74) *Attorney, Agent, or Firm* — Norton Rose Fulbright US LLP

(57) ABSTRACT

Certain embodiments are directed to a machine that stabilizes the lumbar spine in anatomic position while stretching the hamstrings, tensor fascia lata, and lliotibial (IT) band.

6 Claims, 5 Drawing Sheets

(56) References Cited

U.S. PATENT DOCUMENTS

| | | | | |
|---|---|---|---|---|
| 2005/0227837 | A1* | 10/2005 | Broadbent | A61H 1/0237<br>482/148 |
| 2006/0116262 | A1* | 6/2006 | Pandozy | A63B 23/0211<br>482/142 |
| 2009/0305856 | A1* | 12/2009 | Pandozy | A63B 23/0211<br>482/140 |

* cited by examiner

STRETCHING MACHINE

PRIORITY CLAIM

This Application claims priority to U.S. Provisional Patent Application Ser. No. 61/750,893 filed Jan. 10, 2013, which is incorporated herein by reference in its entirety.

BACKGROUND

Chronic lower back pain is a sizeable problem in the United States causing significant cost, lost days from work, and lower production while at work, as well as other psychosocial affects. It is estimated that 28% of the U.S. industrial work force will experience disabling low back pain at some time while 8% of the entire working population will be disabled in any given year. Hamstring tightness has been thought to aid to or worsen back pain although traditional hamstring stretches have shown marginal benefit. Furthermore, limited flexibility in athletes can lead to musculoskeletal overuse injuries and significantly affect function or return to play, hamstrings being one of the most common injuries.

There is a need for additional ways to alleviate musculoskeletal causes of lower back pain.

SUMMARY

One of the most common injuries in many sports is muscle strains or tears, especially hamstrings. Adequate stretching of these muscles prior to and during athletic endeavors is known to reduce the risk of such injury. Described herein is a machine for stretching muscles of the leg and hip while reducing the strain on lower back muscles. Certain embodiments include a machine that is operated by a therapist to stretch muscles and/or measure and trend the flexibility of a patient. Other embodiments are directed to a machine that is a "self operated" device. The self-operated embodiment can be used in, for example, gyms, homes, and sidelines of sport fields. In certain aspects, self-assist mechanisms can be included to assist in moving portions of the machine in different planes of movement. Certain embodiments can be configured with adjustable resistance and used as a strengthening device or training device to strengthen hip, leg muscles, etc. Another embodiment can include electrical stimulation to the muscles of the lumbar spine, the hamstrings, and/or the quadriceps in order to facilitate strengthening of muscles. Electrical stimulation can also facilitate the reciprocal inhibition reflex, enhancing the efficacy of the stretch. The machines described herein would be useful in football, soccer, track, gymnastics, ballet, martial arts and the like to increase flexibility, as well as in the physical therapy gym for therapeutic purposes.

Certain embodiments are directed to a stretching machine comprising: (a) a platform having a lumbar support configured to support a lordotic position; (b) a leg support having a thigh support portion and a foot support portion, wherein the thigh support portion and the foot support portion are connected by an adjustable portion; (c) the machine having the leg support moveably attached to the platform. The leg support is configured so that a force can be applied down the long axis of the leg support. In certain aspects the force is applied using the foot portion. A machine is configured so that a subject can be positioned in the machine and/or the machine adjusted such that the lumbar support is appropriately positioned at the lower back and force is able to be applied down the long axis of the leg support to maintain the subject in a lordotic position. In certain aspects the leg support is operatively connected to an articulation that is configured to rotate independently within planes perpendicular and/or parallel to the platform.

Certain aspects are directed to a method of stretching the hamstring of a subject comprising positioning and securing a subject in a machine as described herein and manipulating the leg of the subject to stretch the hamstring.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

The use of the word "a" or "an" when used in conjunction with the term "comprising" in the claims and/or the specification may mean "one," but it is also consistent with the meaning of "one or more," "at least one," and "one or more than one."

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

DESCRIPTION

One concept underlying embodiments described herein is that many cases of musculoskeletal lower back pain are directly related to hamstring tightness combined with an inability of core lumbar para-spinal muscles to overpower the powerful shortened hamstring muscles. As a result, patients find it difficult to maintain correct posture, which in turn causes more mechanical stress on discs, facets, and ligaments ultimately leading to instability. This instability leads to increased strain of the lumbar muscles triggering myofacial pain and muscle spasms. When instructed to stretch hamstring muscles to relieve the tension on the lumbar spine, a patient inevitably lengthens the lumbar muscles in an attempt to lengthen the hamstrings. Many techniques and machines have been developed to stabilize the pelvis during these dynamic stretches in an attempt to keep the lumbar spine in a neutral position, but these machines do not sufficiently stabilized the pelvis.

Certain embodiments are directed to a machine that stabilizes the lumbar spine in anatomic position while stretching the hamstrings, tensor fascia lata, and lliotibial (IT) band. Such a machine can be used to alleviate or reduce lower back pain. In certain aspects the machine will support the natural lumbar curve in the process of hamstring stretch. The hamstrings can lengthen from origin to insertion rather than pulling on the ischial tuberosity and displacing the lumbar spine out of lordosis—the machine is designed to stretch hamstrings without flattening out the anatomical curve of the lumbar spine.

Figure 1:
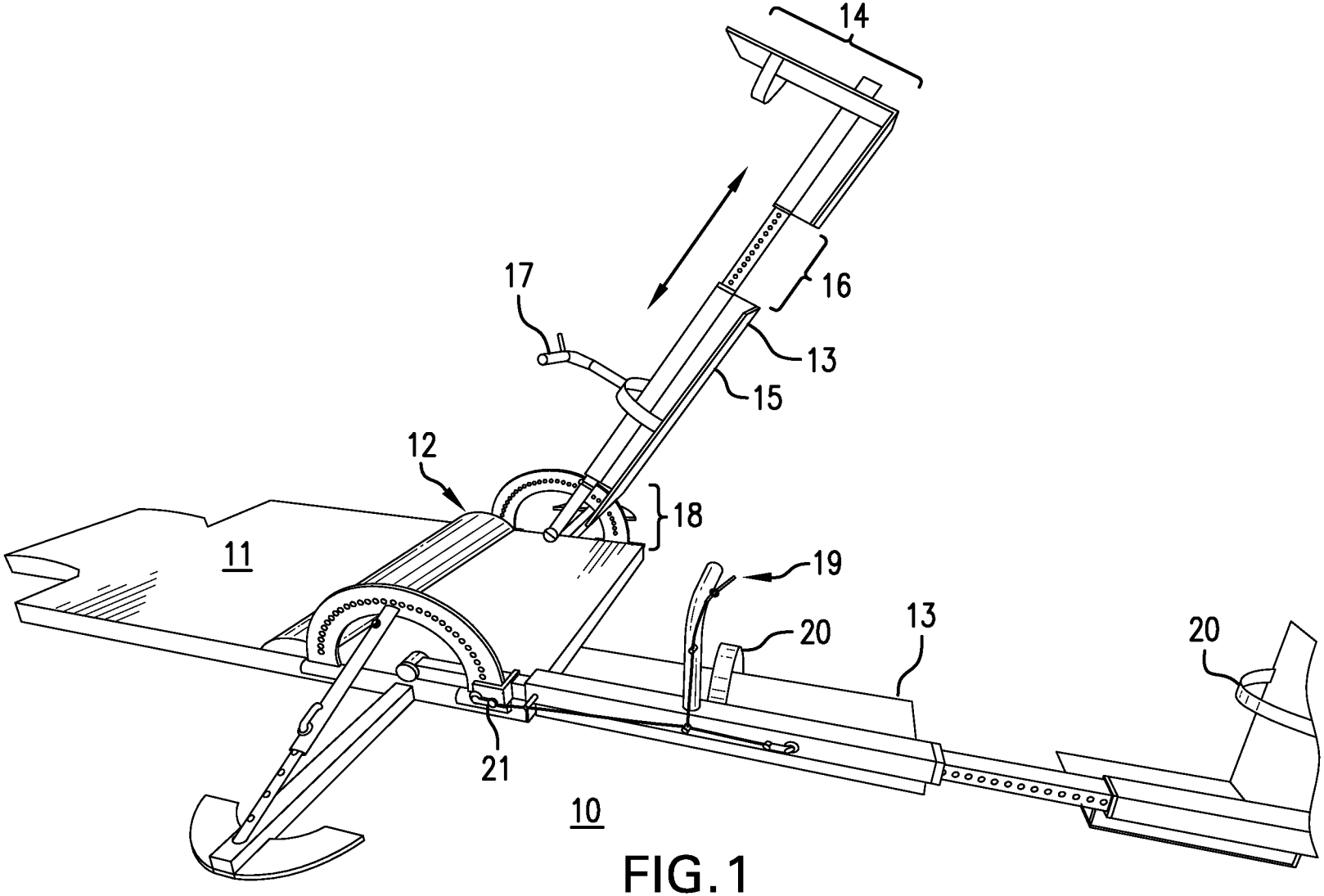
FIG. 1. An illustration of one embodiment of a hamstring stretch machine.

Referring to FIG. 1, one embodiment of hamstring stretching machine 10 is designed to position a subject on a lumbar support 12 that places their lumbar spine in anatomic position. The lumbar support is supported by platform 11. Lumbar support 12 allows a patient with their back against platform 11 to raise or have raised leg support 13 up off the horizontal plane of platform 11 until the patient feels a stretch in the hamstring. In certain aspects the height and/or position of lumbar support 12 relative to platform 11 can be adjustable. Leg support 13 has distal foot support 14 and proximal thigh support 15, wherein foot support 14 and thigh support 15 are connected by an adjustable portion 16 that allows foot support 14 to be positioned such that force is applied through the long axis of the leg. The force applied along the long axis of the leg positions the lumbar spine over the lumbar support and anteriorly rotates the hip of a subject positioned in the device. The force along the long axis can be applied using manual force, mechanical force (e.g., screw or spring mechanism), hydraulic force or the like. Mechanical and hydraulic force may be applied through a motor, caliper, crank drive, or the like. One aspect of positioning a subject's leg in the leg support is to elongate the hamstring muscle from origin to insertion while stabilizing the hip. Adjustable portion 16 allows foot support 14 to move relative to thigh support 15. In certain aspects, handle 17 is operatively connected to foot support 14 in order to place force along the long axis of the leg. Leg support 13 can be adjusted to force the hip to platform 11, locking the lumbar spine in anatomic lordosis. This application of force along the leg maintains the anatomic position of the lower back. The maintenance of anatomic position relieves stress on the lower back and reduces the risk of back injury while allowing stretching of the hamstring and/or hip flexors.

The proximal end of leg support 13 is connected to platform 11 using articulation 18 or the equivalent. Articulation 18 in the embodiment of FIG. 1 allows the movement of leg support 13 in the plane perpendicular to the long axis of platform 11. Handle 17 can be used to assist in the lifting of the leg. In certain aspect a person or an additional mechanism can be used to assist in lifting leg support 13. Thus, the raising of the leg can be assisted or self-assisted. In certain aspects platform 11 can be position at an angle of 1, 2, 3, 4, 5, 6, 7, 8, 9, 10, 15, 20, 25, 30, 35, 40, 45, up to 90 degrees relative to the floor, including all values and ranges there between.

In certain aspects the subject can operate the machine using manual or motor assisted controls equipped with brake 21 that is operatively connected to brake handle 19 that will allow the patient to stop the stretch at the appropriate point. This position can be held for a designated time period. The position can be released and the patient can return to neutral. In certain aspects a braking system can be used by the user in the machine by pressing a brake handle 19 or by a third party assisting the person being stretched. In certain aspects the brake system can be a hydraulic system, a spring operated system, or a disc system. The brake system can be used to slow or stop motion of the machine. The braking system can be configured to brake or lock the system in a particular position for a time period. In certain aspect the brake is illustrated as discs between the plates of the articulating joints. In certain aspects a brake system can be activated by moving a lever that activates a spring-loaded system to lock the machine in position. In other aspects knob can be engaged to lock the machine in position.

In certain embodiments one or more of the adjustable portions can be configured with a measuring device (e.g., ruler, goniometer, dynamometer, force meter, etc.) to quantitate either distance, range of motion, force, or any other measurable parameter. These measurements can be used, for example, to record progress in range of motion, record changes in strength, or to record various parameters or settings associated with a particular subject. Each range of motion associated with the machine can be operatively coupled to an adjustable resistance to provide for strengthening muscles associated the various motions of the leg and hip.

Figure 2:
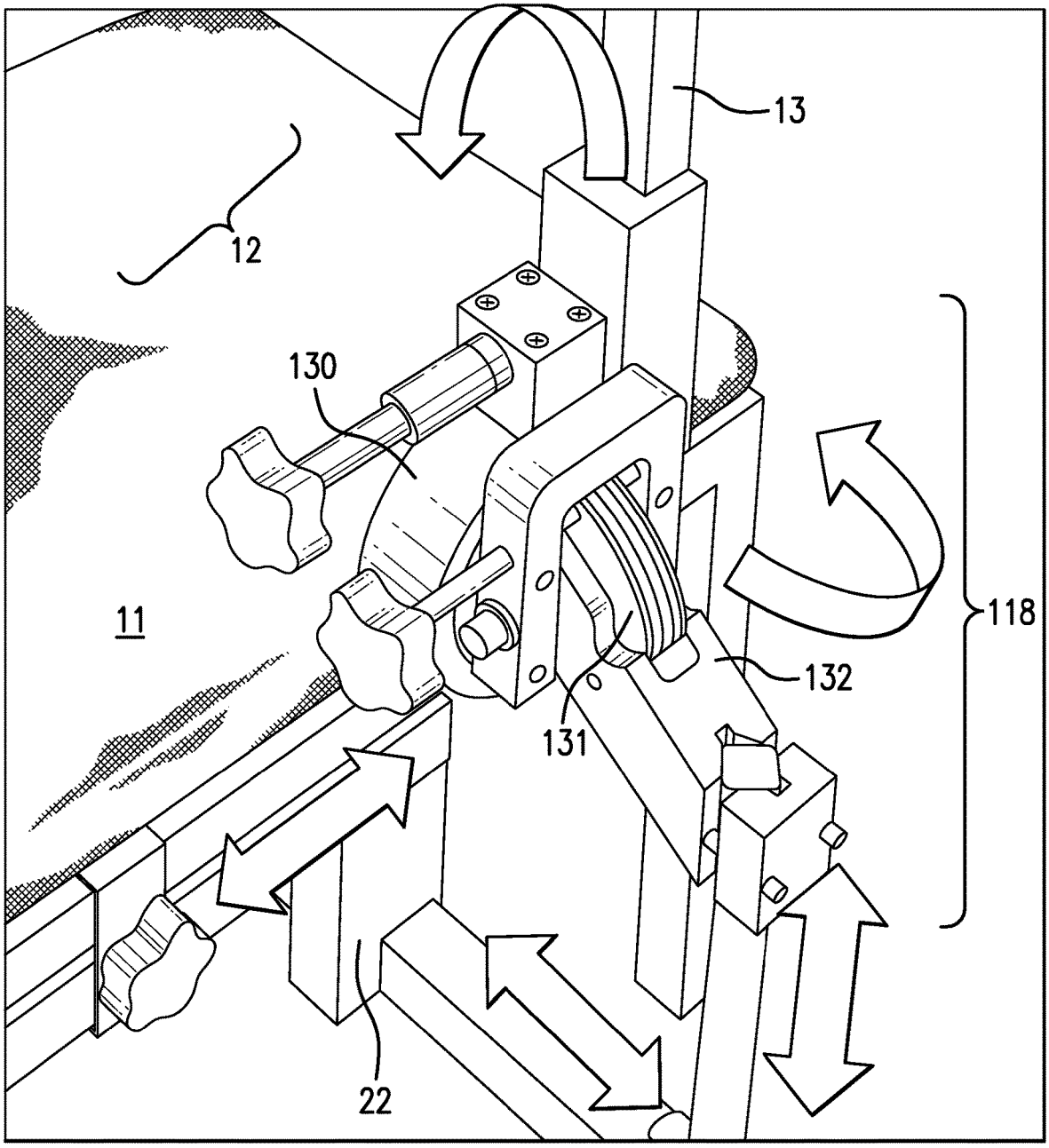
FIG. 2. An illustration of one embodiment of an articulation for a hamstring stretch machine.

In other embodiments illustrated in FIG. 2, the machine can be configured to cross the midline in adduction in order to target the hamstrings, gluteal, tensor fascia latae, and lliotibial band musculature and tendons. FIG. 2 shows articulation 118. Articulation 118 is designed to rotate around component 130 and 131 providing two degrees of freedom in articulation 118, as illustrated in FIG. 2 by the semicircular arrows. In certain aspects articulation 118 is configured to have two perpendicular axis of rotation. In one aspect, platform 11 can be adjusted to position lumbar support at the appropriate position relative to leg support 13 by moving platform 11 relative to base 22. In certain aspects articulation 118 can be configured to move with respect to the opposing articulation 118 to adjust the distance between the articulations. In another aspect articulation 118 can be configured so that the height of the articulation relative to the floor and platform 11 is adjustable. The machine will effectively provide movement of the leg in 3 planes while keeping lordosis of the lumbar spine. Articulation 118 can be substituted using other mechanical articulations, such as a ball and socket joint and the like.

In certain aspects the machine operates in 3 planes of movement. First, it raises the leg, flexing the hip, and stretching the hamstring muscle group. Second, it telescopes the leg down toward the ground, effectively forcing the lumbar spine into normal "correct" anatomical alignment.

The draping of the lumbar spine over lumbar support 12 causes the pelvis to anteriorly tilt which moves the ischial tuberosity farther away from the femur (origin to insertion of this muscle is now elongated). Most other devices or methods that are used to stretch the hamstrings do not lock the lumbar spine into lordosis while "passively" stretching the hamstrings and hip extensor muscle groups. They merely allow the lumbar spine to elongate as well which does not isolate the hamstring muscle group. It actually aggravates the low back pain. Another aspect of this device is the fact that it not only stretches the hamstrings and hip extensors, it also simultaneously stretches the abductor muscle group by bringing the leg across midline effectively elongating the iliotibial band which is notoriously difficult to isolate and stretch. As an added benefit, the device will also stretch adductor muscles (do the splits), which is desirable to martial artists and dancers who need the added flexibility for their sports.

Use of the machine solves a number problems including: (i) lower back strain and pain caused by increased tightness of the hamstring muscles that place stress on the lumbar spine, (ii) overuse injury and hamstring tears in athletes, (iii) chronic pain from pressure on discs of the lumbar spine in patients with lumbar discogenic pain, (iv) lliotibial band tightness and pain from anatomic changes in gait secondary to this tightness, (v) Sciatica caused by piriformis or gluteal muscle tightness pressing on sciatic nerve, and (vi) overall inflexibility which leads to increased likelihood of injury. In certain aspects the machine can help elderly individuals with falls since hamstring tightness and hip flexor weakness are leading causes of the elderly not being able to clear their feet during gait leading to falls and hip fractures.

Certain embodiments can be directed to methods using the hip mechanism in a slow, progressive, assisted range of motion for patient post hip transplant or hip surgery to assist with post operative range of motion while ensuring the hip joint stays in socket. The machine can further comprise a similar articulation mechanism or knee hinge mechanism, that can be optionally locked to maintain a particular position, placed at the knee for knee movement as well post knee surgery.

In certain aspects movement of the machine can be assisted with multiple different mechanisms from hydraulics, to air, to gas, to electric motor and the like.

In certain aspects the machine can be used to accurately measure pressure required and degree of flexibility obtained in 3 planes (i) hip flexion without lumbar anatomically normal lordosis, (ii) hip flexion with anatomically normal lordosis (obtained through telescoping leg toward floor), and (iii) degree of adduction of hip across midline with or without lordosis maintained. The apparatus can also measure degree of hip angle with abduction of hip away from midline.

Figure 5:
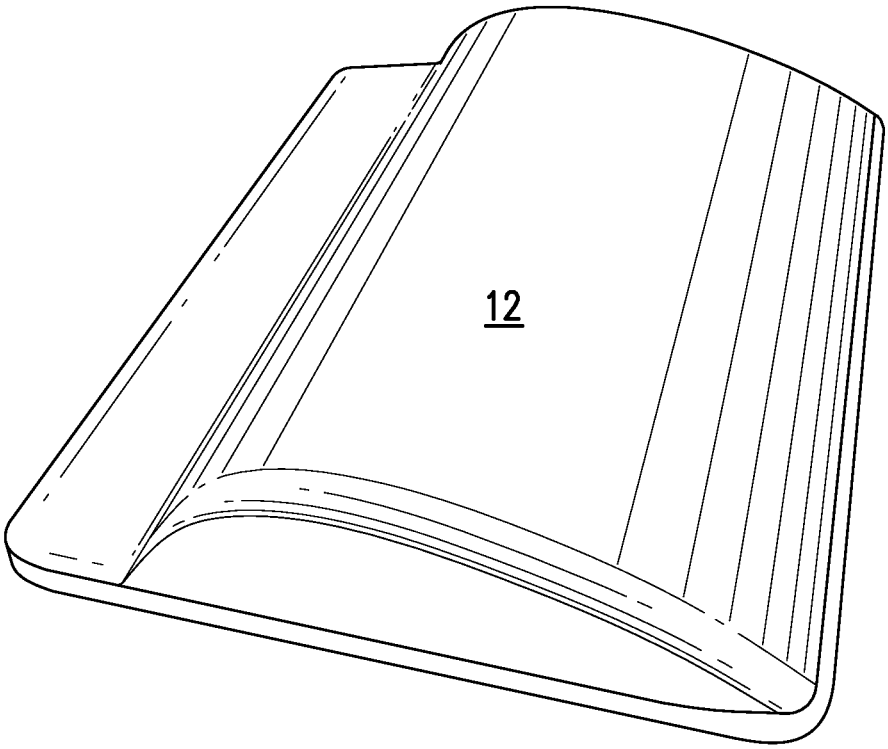
FIG. 5 Illustrates one example of a lumbar support.

The machine can be made of steel, aluminum, or other materials that provide stability for operation of the machine. In one embodiment the frame sits approximately 18 inches off the ground and is made out of square beams around 2×2 inches. It has a gliding track that has very fine adjustment ability to which leg support 13 is attached. In certain aspects platform 11 is made out of wood, covered with foam padding and topped with a neoprene "Spenko" stretchable covering. In certain embodiments, lumbar support 12 is made out of custom hard molded plastic (FIG. 5) covered by the same Spenko material. The curve of lumbar support 12 is designed to mimic the normal anatomic lordodic curve. In certain aspects lumbar support 12 can be adjusted, by inflation, etc., to fit particular subjects.

Figure 3:
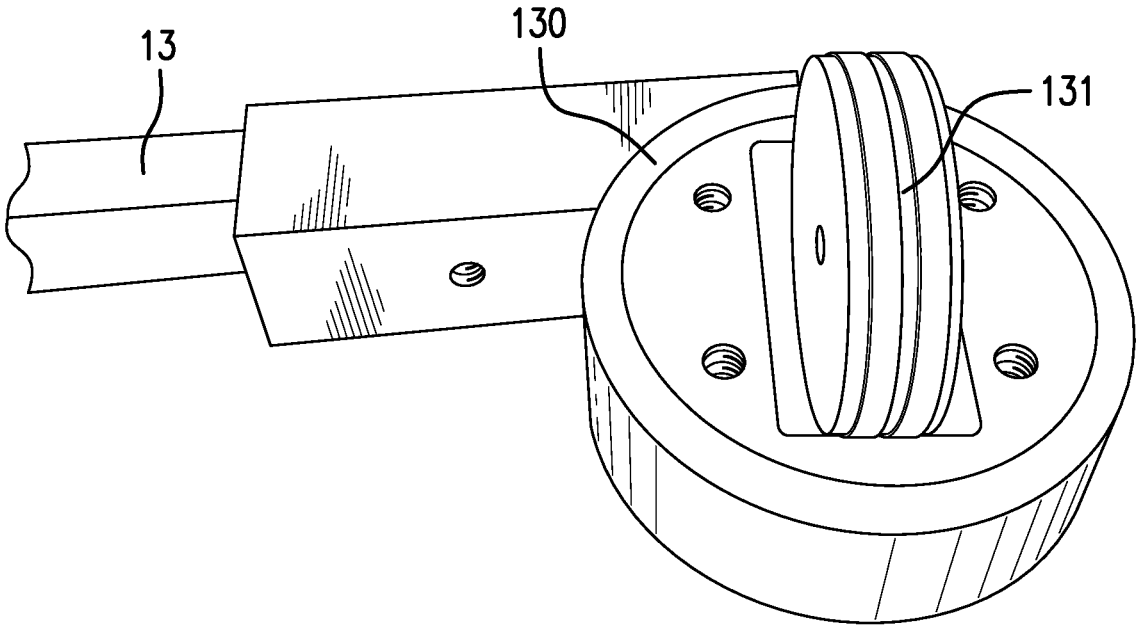
FIG. 3. An illustration of the components of one embodiment of an articulation for a hamstring stretch machine.
Figure 4:
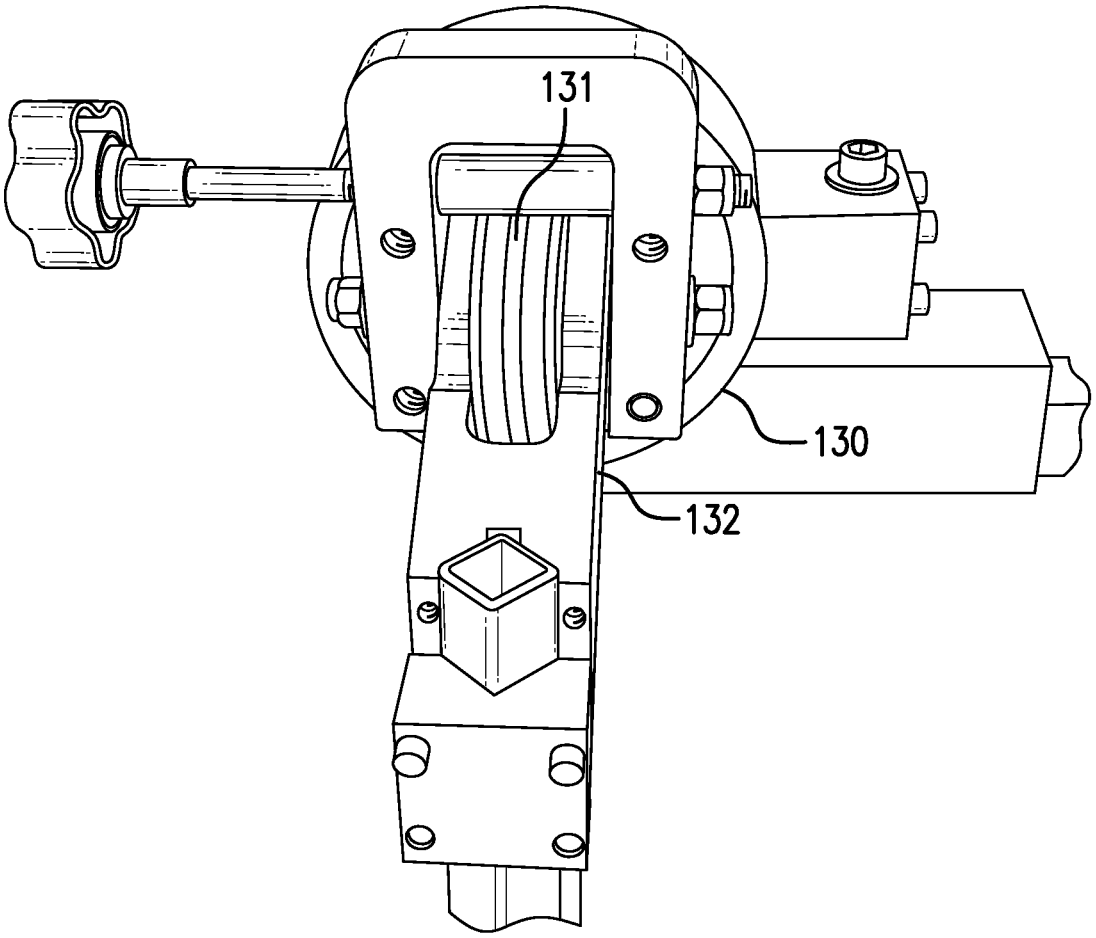
FIG. 4. An illustration of one embodiment of an articulation position in the gliding cradle for the articulation.

In certain embodiment, articulation 118 was created to mimic the motion of the hip joint. Referring to FIG. 3 and FIG. 4, articulation 118 comprises pivot point 131 with another pivot point 130 that it is inset into the first. This allows the joint to have a single point of pivot but still move in two different planes. Pivot point 130 is operatively coupled to leg support 13. Articulation 118 is attached to base 22 by a gliding cradle 132 (see FIG. 2 and FIG. 4). The machine has right and left leg supports 13. The subject lies down on platform 11 and places their legs on the leg supports 13. Once adjusted to the correct leg length, it has straps 20 to keep the knee in full extension. In certain aspects brakes 21 can be included and operated by brake handle 19. The brakes, if included, are plastic sandwiched by metal discs that can be tightened with a lever, or spring loaded, or assisted to allow movement or restrict it

The invention claimed is:

1. A stretching machine comprising:

(a) a platform having a lumbar support configured to support a lordotic position; and (b) a leg support operatively coupled to the platform at an articulation that is configured to rotate independently within two planes perpendicular to the platform, the leg support having a thigh support portion and a foot support portion, wherein the thigh support portion and the foot support portion are connected by an adjustable portion;

wherein the foot support portion is configured to apply a force down the long axis of the leg, stabilizing the pelvis of a subject by application of pressure along the long axis of the leg and maintaining the lumbar spine of the subject in anatomic lordosis.

2. The machine of claim 1, wherein the leg support is operatively coupled to a goniometer, dynamometer, force meter, and/or ruler.

3. The machine of claim 1, wherein the lumbar support is adjustable relative to the platform.

4. The machine of claim 1, wherein the platform is adjustable relative to the leg support.

5. The machine of claim 1, wherein the articulation is configured to be adjustable relative to the platform, a floor, and/or a second articulation.

6. A method of stretching the hamstring of a subject comprising positioning and securing a subject in the machine of claim 1 and manipulating a leg of the subject to stretch a hamstring of the leg.

* * * * *